US011408702B2

(12) United States Patent
Reis-Green et al.

(10) Patent No.: US 11,408,702 B2
(45) Date of Patent: Aug. 9, 2022

(54) FIREARM MUZZLE ACCESSORY COUPLING DEVICE, SYSTEM AND METHOD

(71) Applicants: Austin Reis-Green, Watertown, WI (US); Evan Reis-Green, Juneau, WI (US)

(72) Inventors: Austin Reis-Green, Watertown, WI (US); Evan Reis-Green, Juneau, WI (US)

( * ) Notice: Subject to any disclaimer, the term of this patent is extended or adjusted under 35 U.S.C. 154(b) by 0 days.

(21) Appl. No.: 16/948,730

(22) Filed: Sep. 30, 2020

(65) Prior Publication Data

US 2021/0389074 A1 Dec. 16, 2021

Related U.S. Application Data

(60) Provisional application No. 63/039,642, filed on Jun. 16, 2020.

(51) Int. Cl.
*F41A 21/32* (2006.01)

(52) U.S. Cl.
CPC ..... *F41A 21/325* (2013.01)

(58) Field of Classification Search
CPC ..... F41A 21/30–42
USPC ..... 89/14.2–14.4; 181/223
See application file for complete search history.

(56) References Cited

U.S. PATENT DOCUMENTS 916,885 A 3/1909 Maxim
984,519 A 2/1911 Browning
1,455,661 A * 5/1923 Rhinehart ..... F41A 21/40 42/79
2,695,797 A * 11/1954 McCarthy ..... F16L 37/2445 285/88
4,893,426 A 1/1990 Bixler
5,559,302 A 9/1996 Latka
(Continued)

FOREIGN PATENT DOCUMENTS

DE 202018005980 U1 * 1/2019 ..... F41A 21/325
FI 20041373 A 4/2006

OTHER PUBLICATIONS

YouTube. (Mar. 3, 2017). A-TEC news 2017 presented at IWA. YouTube. Retrieved Mar. 24, 2022, from https://www.youtube.com/watch?v=YwTXzG0NyBc.

(Continued)

*Primary Examiner* — Joshua E Freeman
*Assistant Examiner* — Benjamin S Gomberg
(74) *Attorney, Agent, or Firm* — Dunlap Bennett & Ludwig, PLLC

(57) ABSTRACT

A firearm muzzle accessory coupling device, system and method. The coupling device provides a front alignment taper and an intermediate outer diameter providing a plurality of successively alternating clearance recesses and pattern threaded lugs, wherein each lug provides a unique outward thread. The muzzle accessory provides a mounting interface socket having a plurality of successively alternating socket clearances and pattern threaded socket lugs along an inner circumference of a through bore. Each socket lug providing an inward thread dimensioned and adapted to receive the unique outward threaded muzzle accessory, thereby effectuating a plurality of compatible mating axial orientations between the coupling device and the firearm muzzle accessory.

10 Claims, 4 Drawing Sheets

(56) References Cited

U.S. PATENT DOCUMENTS

| | | | | |
|---|---|---|---|---|
| 6,052,935 | A * | 4/2000 | Howard | F41A 21/40 42/75.02 |
| 7,610,710 | B2 * | 11/2009 | Brittingham | F41A 21/325 181/223 |
| 7,891,282 | B1 * | 2/2011 | DeGroat | F41A 21/325 89/14.4 |
| 8,261,478 | B2 * | 9/2012 | Laney | F41A 3/30 42/51 |
| 8,424,441 | B2 * | 4/2013 | Brittingham | F41A 21/26 89/14.4 |
| 8,978,286 | B2 * | 3/2015 | Schafer | F41A 21/34 42/79 |
| 9,383,154 | B2 * | 7/2016 | Stone | F41A 21/481 |
| 9,513,078 | B1 * | 12/2016 | Fulton | F41A 21/30 |
| 9,739,560 | B1 * | 8/2017 | Salvador | F41A 21/325 |
| 10,184,744 | B2 | 1/2019 | Young et al. | |
| 10,753,700 | B2 * | 8/2020 | Wolf | F41A 21/325 |
| 11,054,208 | B2 | 7/2021 | Johansen et al. | |
| 11,156,423 | B2 | 10/2021 | Winterseth et al. | |
| 2019/0226788 | A1 * | 7/2019 | Johansen | F41A 21/325 |

OTHER PUBLICATIONS

GunMartTV. (Sep. 9, 2020). A-tec H2 moderator with A-LOCK fitting review. YouTube. Retrieved Mar. 24, 2022, from https://www.youtube.com/watch?v=wPnWM7_Lx0M.

YouTube. (Sep. 28, 2018). A-TEC optima 45 MIT A-Lock Mini Adapter. YouTube. Retrieved Mar. 24, 2022, from https://www.youtube.com/watch?v=bHHsFh0P_5o.

Silden, I. (n.d.). The A-LOCK system. Retrieved Mar. 24, 2022, from https://www.a-tec.no/a-lock.

* cited by examiner

FIREARM MUZZLE ACCESSORY COUPLING DEVICE, SYSTEM AND METHOD

CROSS-REFERENCE TO RELATED APPLICATION

This application claims the benefit of priority of U.S. provisional application No. 63/039,642, filed 16 Jun. 2020, the contents of which are herein incorporated by reference.

BACKGROUND OF THE INVENTION

The present invention relates to a mounting system for firearm silencers, including pistol silencers for pistols which require a Neilson device, also referred to as a recoil booster to achieve reliable function, and, more particularly, a firearm muzzle accessory coupling device, system and method.

Firearms silencers were first developed in a practical functional, saleable, and marketable sense in the early 1900's by Hiram Percy Maxim, and the Maxim Silent Firearms Company. Hiram Maxim's designs were advanced. His patent design of U.S. Pat. No. 916,885 shows an early practical silencer system with functional similarity to a system featured in Finish patent FI20041373, popularly sold in Europe today. Around the time Maxim was marketing the silencer, in 1910 John M. Browning designed a tilt locking barrel system that allowed wildly popular and safely operational automatic pistols to be produced. Browning's automatic pistol design was the subject of U.S. Pat. No. 984,519A. The tilt barrel system requires the barrel muzzle to be lifted to unlock the pistol. These systems, known in industry as "Browning type" systems, are used in Colt, Glock, Sig Sauer, Heckler and Koch, Remington, Smith and Wesson, and other brand, modern firearms. Nearly all auto-loading pistols sold today use derivatives of this system. The "Browning type pistol" has a weakness as it relates to silencer compatibility, in that the system only tolerates between approximately 3 and 5.8 ounces of static, barrel muzzle attached silencer weight, before the silencer disables the tilt locking function. With the tilt locking function disabled, the pistol is not able to function automatically as intended. Pistol silencers, which are effective in noise reduction are commonly eight or more ounces in weight. This problem was not addressed until the late 1980's when Qual-A-Tec, a silencer research company serving Navy Seal Teams, developed a recoil boosting device, that became known as a "Nielsen Device", also commonly referred to as a "booster". Qual-A-Tec's original Nielsen device was designed to allow newly adopted Browning style unlocked, SIG 226 pistols to function reliably with silencers. The Nielsen device achieved this by using gas pressure in the silencer to drive a piston mount interface thread attached to the barrel rearward, assisting rearward motion of the slide, and unlocking of the barrel. This device was never patented. In the early 90's Doug Olson, an engineer from Qual-A-Tec, was hired briefly by Automatic Weapons Company during the period when the AWC Nexus suppressor with Neilson device was designed. Doug Olson then transitioned to Knights Armament Corporation. At Knights, Doug became involved in the offensive handgun suppressor program which developed the Knights OHG suppressor, which provides prior art for the 10 tooth, sprocket like bearing surfaced, Nielsen device "piston mount" which is the predominant pistol suppressor barrel mount interface that is used in nearly all pistol suppressors in the USA today.

Civilian consumers, as evidenced in a circa 1916 Maxim brochure, have always had a desire to quickly attach silencers. On page 6 of the brochure, Maxim speaks on this in point 4. "The thread in the silencer will be found to be interrupted. If the thread on the gun barrel is interrupted on opposite corners to correspond, the silencer can be dropped into place and fastened by a single quarter turn." The Maxim 1920 suppressor with the interrupted thread interface has three flaws with the system. The thread is a single point conventional thread wherein the entire profile shares a single continuous helical path that is then interrupted by machining away some of the thread. The Maxim interrupted thread silencer will only tighten in one orientation, but the silencer allows installation to be attempted in two orientations. In the wrong position of two orientations, the silencer will not tighten to a shoulder before the threads move through the entire interruption into clearance, causing the silencer to be again detached. False positives promote catastrophic failure of units in customer hands. This extra mounting position doesn't promote speed or ease of use. In the event of improper initial orientation, the end user has to clumsily re-attempt installation, re-engaging the thread, and turning further to one full revolution to mount the silencer.

The Maxim interrupted thread silencer also doesn't have any designed means of staying tight other than prevailing torque on square shoulders. Pistol silencers are commonly hand installed in the field without tools, so it doesn't promote ease of use, or end user confidence to depend on torque limited to human grip on a small tube. The tilt barrel pistols operate (tilting and oscillating) violently, and so vibration is a major source of silencer loosening. In the Maxim design, the rear shoulder is the sealing surface. There was no forward sealing surface in the maxim design, so the exposed and unsealed interrupted Maxim threads would become dirty and potentially lead or copper brazed together from extended use. The use of two sections of thread at 180 degrees is less than ideal for even mating force across the silencer interfacing shoulder, and coaxial bore alignment is absolutely critical in silencers to ensure bullet clearance. US20190226788A1 of A-TEC holdings AS Norway, is a patent currently pending on essentially the same Maxim concept, differing in that a pair of shoulders is provided with the similar, interrupted, single continuous path conventional thread as shown in FIG. 3 of US20190226788A1, permitting a single correct mounting orientation and limitations similar to the original Maxim prior art. These feature similarities are a square shoulder, a single point conventionally cut thread, an equal number of threaded and unthreaded portions, and a single compatible mounting orientation amid a plurality of possible positions. The A-TEC design, worse than Maxim's prior art, allows three possible bayonet positions for two possible false positives, where Maxim only offered one incorrect position.

The desire of military and civilian shooters to quickly attach suppressors led to the development of the 3-lug mount. In U.S. Pat. No. 4,893,426, Tim Bixler teaches a 3-lug system with a spring detented interface. This interface required multiple revolutions to tighten the suppressor but was faster than direct thread mounting, requiring only 3-4 revolutions, rather than 8-10 as with a conventional thread interface. Later in U.S. Pat. No. 5,559,302, Greg Latka displayed developmental improvement of Bixler's invention with the spring loaded 3-lug coupler assembly. These allowed rapid attachment with 60 degree push and twist function in all three orientations, but mechanically there was little room for springs in the system, so springs in these production units were thin and very weak. Manufacturing tolerances of the Latka system involved 4 diameters with short bearing surfaces, causing a considerable amount of stacked tolerance slop. These mounts added considerable length to silencers and allowed silencers to rattle wildly, in and out of coaxiality during firing, causing loss of accuracy, and baffle strike risk to the silencer. The critical spring and O-rings inside these units are also capable of being baked, as the silencer can reach temperatures in excess of 1000 F. Neither of these systems could mount a Nielsen device (or recoil booster) equipped suppressor.

In U.S. Pat. No. 7,610,710B2, Kevin Brittingham improved the interrupted, single conventional thread attachment of Maxim by making one lug dissimilar in size to the other, and adding an O-ring, in an attempt to provide mounting in less than one half turn, and address some of the issues with the Maxim design. Because Kevin Brittingham's design still used an interrupted single point conventional thread, it failed to provide multiple attachment point functionality to address the slow and cumbersome nature of finding the then single allowable mating orientation. Rubber/elastomeric O-rings also fall short of ideal retention, as they simply provide slight prevailing torque from friction, and have low temperature limitations nearly half that of stainless-steel Nielsen springs, as well as being prone to wear. This lack of mounting security and durability is evident, as Remington's AAC made a Nielsen piston which featured a pair of O-rings video marketed as more secure than one O-ring. Despite dual O-rings and angled piston ports aimed at keeping silencers secure, Michael Leighton Smith, an engineer who spent 20 years with AAC recently mentioned in an online forum that AAC used vibratite thread sealant when durability testing silencers, something that obviously should not be necessary if two O-rings could functionally keep the silencer tight.

The Brittingham interrupted thread device, like Maxim's, required up to nearly 360-degree search for the correct mating orientation, prior to the final ¼ turn to seat it. The clumsy search for interfacing capability is not appreciated by military or civilian customers, who appear to want speed and convenience, or a less confusing, standard interface. This device is unsurprisingly not offered on the market today by Advanced Armament or Remington, the license holder of the patent.

In U.S. Ser. No. 10/184,744B2, Nolan Young teaches a totally redesigned Nielsen Device, affording 4-lug spring biased attachment similar to Greg Latka's system of U.S. Pat. No. 5,559,302. This system is very complex, expensive, and based on a system with historically known flaws. The Nolan Young system relies completely on spring tension to promote angular alignment. The single forward diameter shown but not called out in FIG. 11 in the Nolan system is too short to provide alignment and a slip fit. Attachment of the 4-lug Nielsen device involves re-moving parts that are not commonly removed for routine, end user maintenance. The Nolan Young system also adds substantial system length and some weight to the suppressor, making storage and use more cumbersome. This system also is not available on the market, six years after the original patent date, potentially for reasons listed above.

As can be seen, there is a need for a practical silencer mounting system that addresses the desire of civilian and military end users to rapidly, with positive mounting security, and with a high degree of coaxial alignment, attach a sound suppressor, including one with a "Nielsen device" or recoil booster, without major negative attributes such as loss of accuracy, loss of system temperature resistance, increase in baffle strike risk, increase in weight or size, etc.

SUMMARY OF THE INVENTION

In one aspect of the present invention, a novel firearm sound suppressor mounting interface and barrel end coupler system is provided. A novel barrel end coupler capable of mating with the suppressor mounting interface socket in a plurality of axial orientations is also provided. The primary means of attachment is a novel interrupted, patterned, plurality of threads which may have a modified, non-standard, helix to pitch relationship. The threads are manufactured on multiple separate axial lug isolated locations representing multiple patterned threads capable of simultaneous engagement in the same bore. The mounting interface may comprise a unique socket geometry natively manufactured into a silencer, or silencer mounting interface such as a Nielsen device/booster piston, permitting a novel means of attaching a silencer to a firearm. The mounting interface may also provide a novel capability to retrofit an existing pistol silencer at minimal cost, with replacement of the booster piston, providing quick attachment and secure mounting, without added system length, to Browning style unlocking automatic pistols which are known to require the assistance of a Nielsen device or booster for reliable function.

In another aspect of the present invention, a firearm coupling device includes the following: a body extending between a rear portion and an alignment taper; an outer diameter of the body having a plurality of successively alternating lugs and clearance recesses; and each lug clearance isolating an outward thread creating a unique functional geometry.

In yet another aspect of the present invention, the firearm coupling device includes the following: a body or portion of a body extending between a threaded barrel end receiving feature and an alignment taper; an outer diameter of the body having a plurality of successively alternating lugs and clearance recesses, wherein each lug and each clearance recess have a corresponding radial length; each lug clearance isolating a separate outward thread creating a unique functional geometry, the unique functional geometry includes the following: a radial start point relative to each axial lug clearance position about a center of the outer diameter; the thread helix may further comprise a unique thread helix relative to the selected thread profile that is not required to be slaved to the profile and number of threads comprising the coupling.

In yet another aspect of the present invention, a system of coupling a muzzle accessory to a firearm includes the following: the above-mentioned firearm coupling device; the companion muzzle coupling mated accessory having a through bore extending through the inside of a receiving portion and a sealing alignment taper; and an inner diameter of the receiving portion having a plurality of successively alternating socket lugs and socket clearance recesses, wherein the plurality of successively alternating socket lugs and socket clearance recesses is dimensioned to operatively associate with the plurality of successively alternating lugs and clearance recesses of the body in such a way as to permit bayonet insertion and contact between the alignment taper and the sealing alignment taper, whereby the patterned threads enable a plurality of axial mounting orientations between said firearm coupling device and the muzzle accessory.

These and other features, aspects and advantages of the present invention will become better understood with reference to the following drawings, description and claims.

Figure 1:
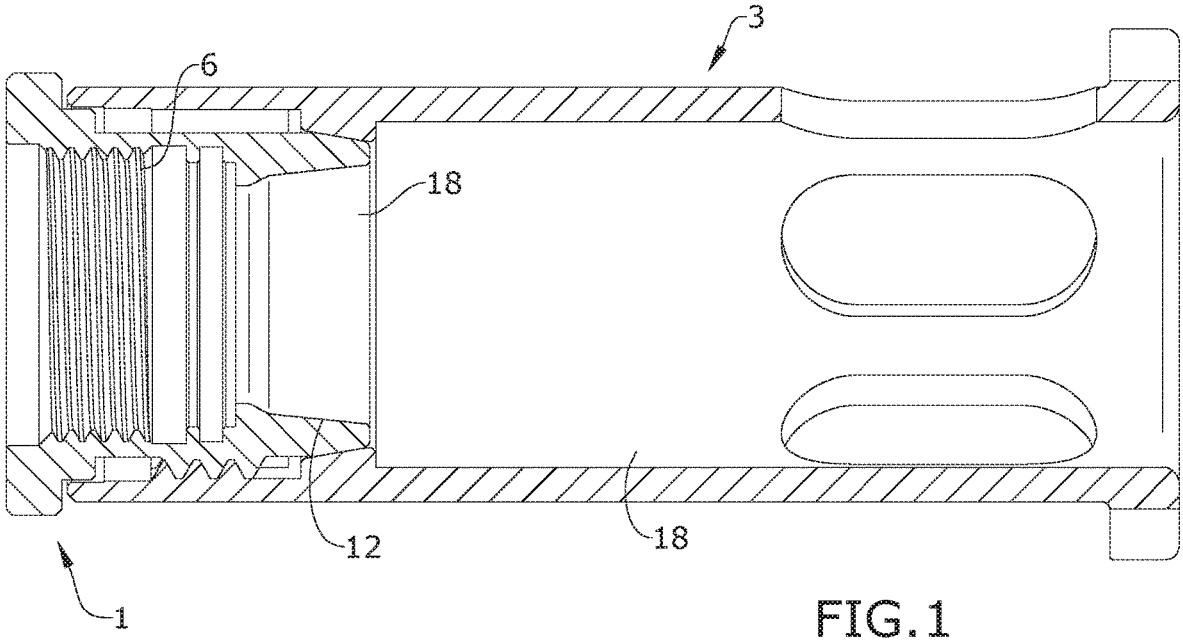
FIG. 1 is a section view of an exemplary embodiment of the present invention [[quick disconnect silencer interface]]
Figure 2:
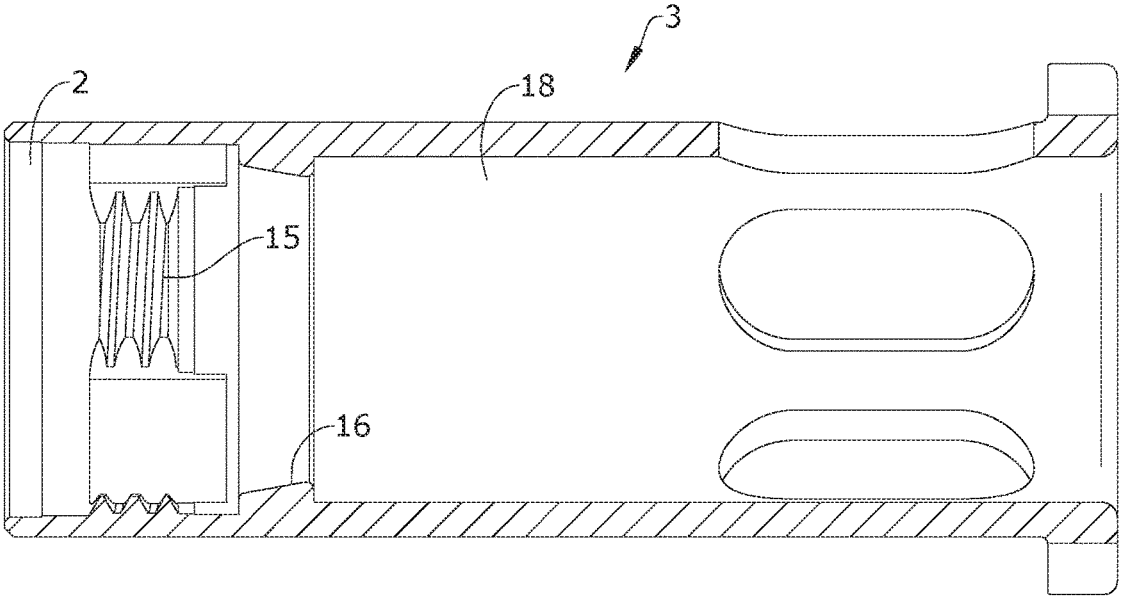
Figure 3:
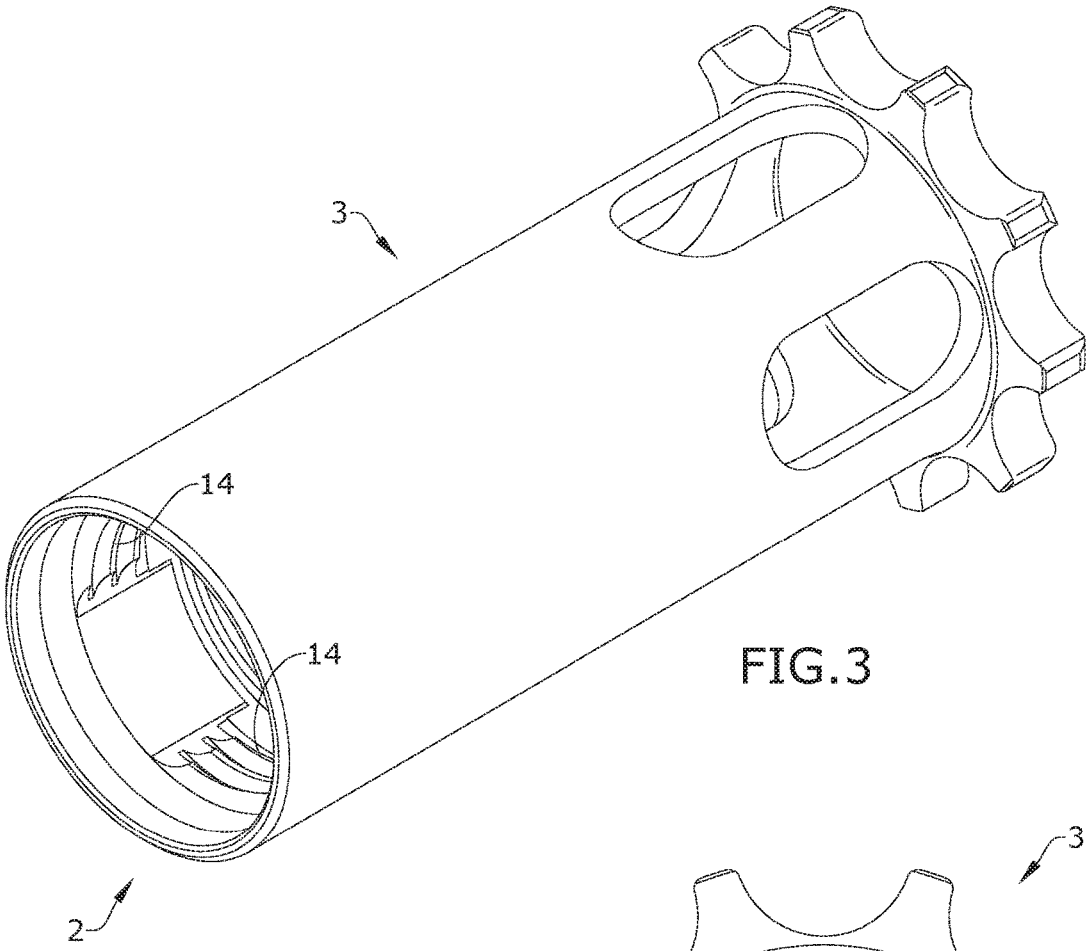
Figure 4:
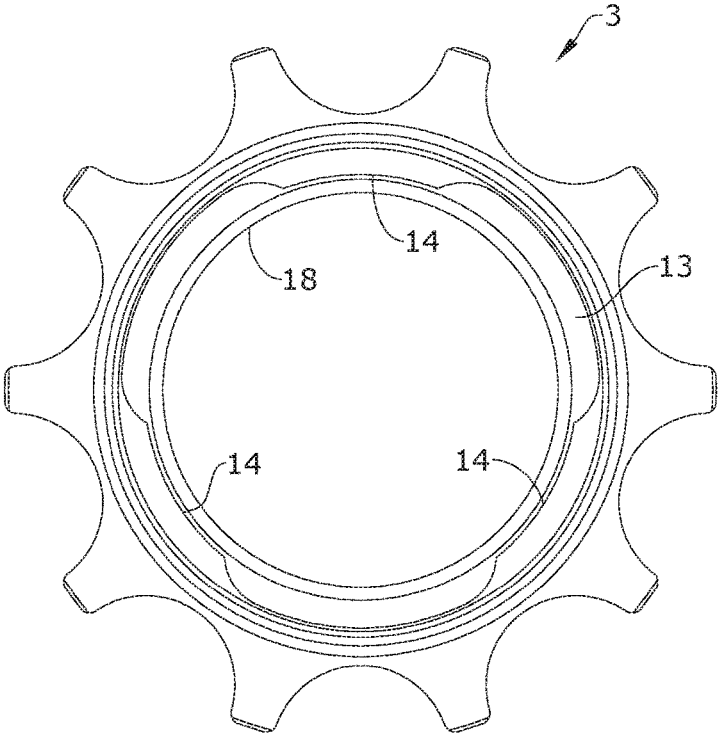
Figure 5:
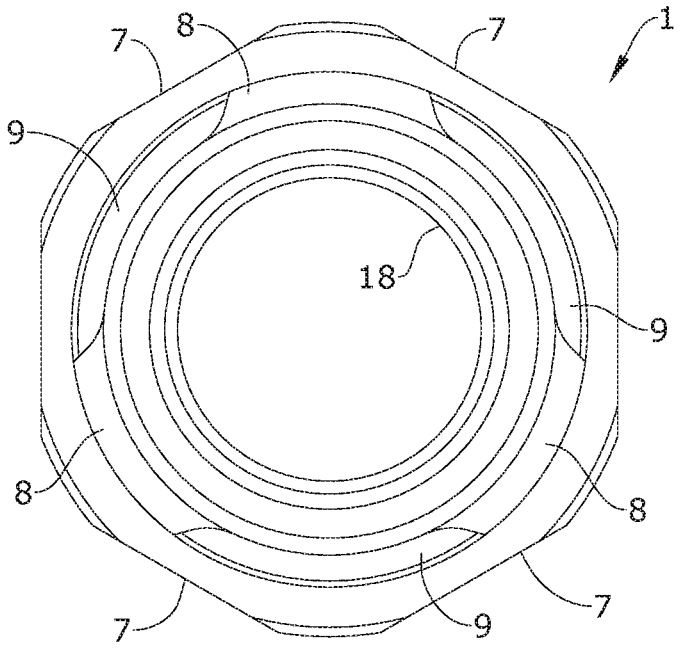
Figure 6:
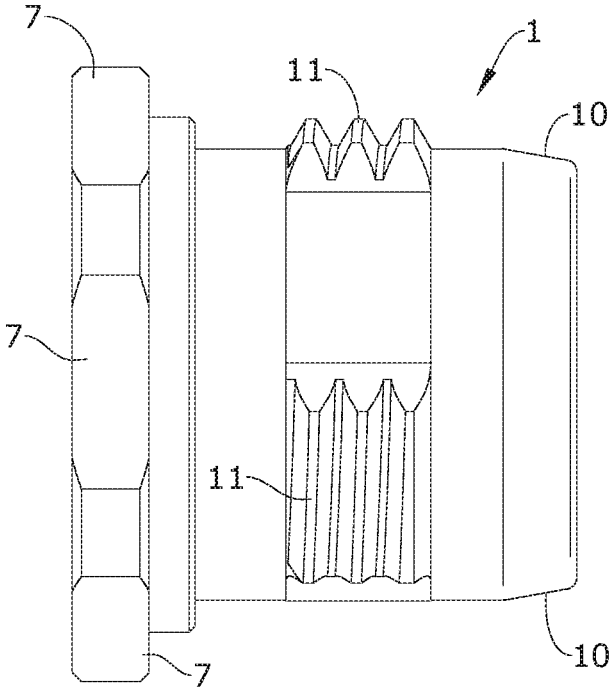
Figure 7:
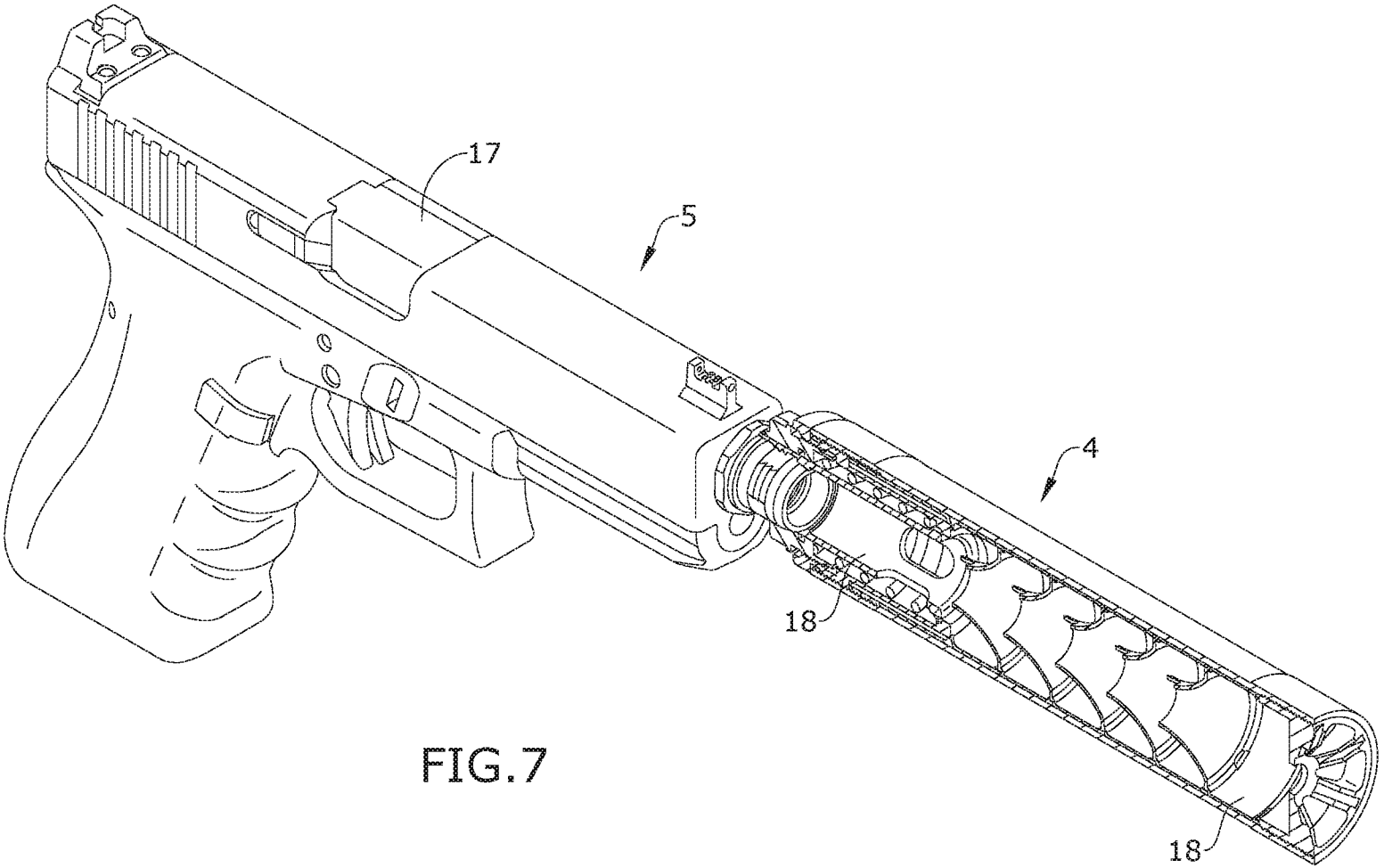

comprising a Nielsen device piston (NDP) or booster piston insert (BPI) and barrel end coupler (BEC);

FIG. 2 is a section view of an exemplary embodiment of the NDP or BPI of FIG. 1;

FIG. 3 is a perspective view of an exemplary embodiment of the NDP or BPI of FIG. 1;

FIG. 4 is a rear view of an exemplary embodiment of the NDP or BPI of FIG. 1;

FIG. 5 is a front view of an exemplary embodiment of the BEC of FIG. 1;

FIG. 6 is a side view of an exemplary embodiment of the BEC of FIG. 1—it should be understood that even though FIG. 6 may appear to show left hand threads and that the piston 3 in FIG. 3 appears to show right hand threads, the appropriate, cooperating handedness of threading is to be used; and FIG. 7 is a perspective view of a Glock 17 with the thread attached BEC of FIG. 6 permitting mounting of a silencer 4 in cutaway view that was adapted to be mounted by retrofitting it with the NDP of BPI of FIG. 3.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Referring now to FIGS. 1 through 7, the present invention may include firearm muzzle accessory coupling device, system and method.

Referring to FIG. 7 for definitional establishment, as used herein, the word "forward" or "front" corresponds with the firing direction of the firearm—i.e., the cartridge (in the breech or "rear" end of the barrel 17) fires with projectile exiting the "forward" or "front" side of each of the parts in assembly.

The outside diameter is defined as outer circumference of parts coaxially surrounding the inside diameter defined by the bore 18 permitting the passage of the projectile fired from the barrel 17 of the firearm 5 when the parts representing an embodiment of the invention are in assembly, such as seen in FIG. 7.

As shown in FIGS. 1, 2, 3, and 7, the present invention pertains to a novel firearm mounting coupler 1 capable of mating with a bore comprising a novel mating interface 2. In one embodiment the mating interface 2 may be natively manufactured into a sound suppressor 4 or into a separate suppressor assembly interface or interfacing component, such as a Nielsen device or recoil booster piston 3 hereinafter referred to as the piston 3. The coupler 1, interfacing piston 3, and sound suppressor 4 each have through bores 18 which in assembly are generally coaxial with the barrel 17 of a firearm 5, permitting the passage of a projectile fired from the mated barrel, 17 of firearm, 5.

The coupler 1 features an internal thread 6 allowing it to be mounted to the threaded end of a barrel 17 of a firearm 5. As shown in FIG. 5, a portion of the diameter of the coupler 1 has a plurality of generally symmetrical lugs 8, and an equal number of generally symmetrical clearance recesses 9. The lugs 8 each receive an axially patterned thread 11, as shown in FIG. 6. Each lug 8 is threaded in a pattern relative to a corresponding lug clearance axial position about the center of the diameter. Each thread 11 is lug clearance isolated, with its functional geometry beginning and ending on an individual lug 8.

The patterned thread 11 may be a number of different industry patterns such as UNF or ACME, or STUB ACME, and may have a helix which is different from the pitch typically associated to the thread profile size chosen, such as a 16TPI UNF pitch profile with a 0.100 inch per 360 degree rotational helix rather than the typical 1/16 or 0.0625 inch per rotation helix typically accompanying a 16TPI pitch, conventional thread. These atypical helix-to-pitch patterned threads are possible without violating their profile on the diameter, because each threaded lug 8 has its own unique radially patterned thread, with functional geometry beginning and terminating on that individual lug 8. Atypical profile pitch to rotational helix angles may be desirable to create manufacturing tolerance allowing successful production of interchangeable parts. In this way, the coupler 1 features a novel thread type, and a novel interfacing method created by the sum of a plurality of separately pattern threaded lugs 8, because the same thread helix—unlike the prior art, single point lathe, or rotary tap threaded designs—does not cut the full circumference, which would represent all of the interrupted lugs 8 as have been cut by one shared thread helix in all prior art suppressors utilizing threaded lugs and clearance recesses.

The coupler 1 may include a tool receiving feature or plurality of tool-receiving features such as the wrench flats 7 allowing the coupler 1 to be securely installed to the firearm 5. A portion of the diameter of the coupler 1 forward of the threads defines an alignment taper 10 also capable of providing a gas seal in assembly to protect the threads from combustion debris and to promote proper function of the attached sound suppressor or muzzle device. The coupler 1 may also serve a secondary purpose as a muzzle device such as a flash suppressor, muzzle brake, or compensator. The coupler 1 shown in FIG. 1 shows a miniature cone type flash suppressor 12. The coupler 1 may also receive a mating interface accessory that itself provides a function traditionally associated with a muzzle device, such as a muzzle brake.

Referring to FIGS. 2, 4, 5, 6 and 7, for the sake of this description, the firearm 5 in FIG. 7 has been configured with installation of the coupler 1 to the threaded barrel 17 of the firearm 5 and suppressor 4 has been configured for novel function by replacement of the prior art piston with a piston 3 wherein the interface bore 2 of the invention is integrated into the piston 3. The novel interface bore 2 of piston 3 features recesses 13 which permit the lugs 8 of coupler 1 to bayonet into the bore 2 of piston 3, until the tapers 10 and 16 are nearly engaged. In the instance of the three threaded lug assembly shown, a 60 degree turn at this point permits the three, patterned and lug clearance isolated outside diameter threads 11 on the coupler 1 to engage the mirrored, three patterned receiving, lug clearance isolated internal threads 15 on lugs 14, pulling the sealing alignment taper 10 on coupler 1 into contact with the sealing alignment taper 16 of the interface bore 2. The contact between sealing alignment tapers 10 and 16 removes tolerance and applies a friction/compression fit permitting no vibration to occur. At this point the piston 3 of silencer 4 is securely attached to the coupler 1 and thus the barrel 17 of the firearm 5. The firearm 5 is now in a firing configuration for use with the suppressor 4, and the respective bores 18 of the barrel 17, coupler 1, piston 3, and suppressor 4 are in alignment, permitting the passage of the bullet fired from the firearm 5. It should be noted that the silencer using the piston 3 and coupler 1 shown can be securely attached in the entire plurality of—in this case three, 120 degree—orientations afforded by the device as shown in the drawings. This multiple orientation interrupted mounting method requires a maximum of 120 degrees or one third of a revolution to align clearance and bayonet the shown interface, and 60 degrees or one sixth of a rotation to tighten the suppressor in any of the plurality of mounting orientations afforded. This novel method creates the fastest mounting interface in the history of silencers.

The design of the present invention may include the following considerations. Conceptually, the firearm coupling device of the present invention may embody three threads which are identical on three different lobes, but which in this case do not share the same single helical path like a conventional single point or shared slaved multiplied pitch and multiple helix like a multiple-index single point thread. If they were a normal single index tapped hole, one would only have one of three indexing positions that would actually mount the silencer because the two wrong indexes would not bring the tapers together.

For instance, if the outward threads of the firearm coupling device were a multiple index (three index) thread, say 1/16" (16 UNF TPI profile insert), the manufacturer would have to cut a 3/16" helix or pitch to allow the three lobes to have threads that would allow three index positions. That coarse helix angle would not be ideal because it would not lock up securely that coarse as there would be little friction and mostly just forward pressure at the taper. Accordingly, the inventors used a 16UNF insert to cut 0.100" helix patterned threads—three individual threads to comprise the mount in this case. The inventors want the violated conventional industry pitch to be dependent, in order to protect the threads regardless of the cut—e.g., a 1/10 stub acme with 0.100" pitch, which would actually be the normal pitch, albeit still the patterned thread, comprised of three lug clearance isolated threads with individual indexes relational to each respective isolating lug clearance. The 1/10 at 0.100" helix could work in another application with a larger diameter interface, but wouldn't work in the confines of a three quarter inch piston shaft diameter. The 1/10 at 0.100 helix would still be a patterned thread, and not a multiple index single point thread.

In manufacturing, the inventors thread-milled the lobes, each with the same geometry at three different positions, violating thread profile to pitch relationship without cutting through the other threads and destroying them as would happen using three conventional threads at different positions. This thread does not have a name—at least none was found by the inventors—and thus had to be invented for this application to support the mounting system invention. For example, it is not supported by Mastercam™—which is one of the most advanced CAM softwares on the planet. (which supports single point, single helix thread milling, and multiple index single point threads like the 16UNF with 3/16" helix described above). The inventors had to employ Solidworks™ CAD depict a spline and Mastercam to contour mill a spline to program the thread milling operation. Mastercam tried to output it in facets because it would not recognize the 3D move as an arc, and the inventors had to scratch that, depict a flat arc, output the arc in G12.1 polar co-ordinate interpolation, in smooth arc motion, using a protractor, math, and a screen overlay from Cimco backplotting software to apply correct Z axis moves to the G12.1 arcs to make the helical moves smooth to support the thread because polar coordinate interpolation works on 90 degree quadrants and the inventors had more than 90-degrees of cutter motion in the path. The toolpath wouldn't output G12.1 helical moves without ceasing to recognize the arcs and splitting the moves into straight line facets. The inventors then duplicated the derived operation at 120-degree intervals. That work was development related to the present invention, which was the lightbulb idea that this novel pattern of three threads and the taper would work and enable the mounting system to provide the novel function revolutionizing firearm silencer mounting, especially for pistol silencers, the other work was figuring out how to manufacture it without tools designed with specific intent to support the manufacture of the geometries.

It should be understood, of course, that the foregoing relates to exemplary embodiments of the invention and that modifications may be made without departing from the spirit and scope of the invention as set forth in the following claims.

What is claimed is:

1. A firearm coupling device comprising:

a body extending between a rear portion and a sealing alignment taper;

an outer surface of the body having a plurality of successively alternating lugs and clearance recesses; and each said lug having a plurality of threads axially spaced apart by a pitch, each said thread defining a helix angle about the outer surface, wherein the helix angle is inconsistent with said pitch.

2. The firearm coupling device of claim 1, wherein each said thread has a radial start point corresponding to an associated lug clearance position.

3. The firearm coupling device of claim 1, wherein each said thread is coextensive with the lug.

4. The firearm coupling device of claim 1, wherein each said thread is lug clearance isolated from the threads of adjacent lugs of the plurality of lugs.

5. The firearm coupling device of claim 1, further comprising a through bore circumscribed by the body.

6. The firearm coupling device of claim 1, wherein the rear portion comprises a tool receiving feature.

7. The firearm coupling device of claim 1, wherein the plurality of successively alternating lugs and clearance recesses comprises three of each of the lugs and the clearance recesses, wherein each said lug and each said clearance recess has a corresponding radial length.

8. A system of coupling a muzzle accessory to a firearm comprising:

a firearm coupling device of claim 1;

the muzzle accessory having a through bore extending through a receiving portion and a sealing taper; and an inner surface of the receiving portion having a plurality of successively alternating socket clearance recesses and patterned threaded socket lugs, wherein the plurality of successively alternating socket clearance recesses and pattern threaded socket lugs are dimensioned to operatively associate with the plurality of successively alternating clearance recesses and lugs of the body in such a way as to permit bayonet insertion of the body and rotation into contact between the sealing alignment taper and the sealing taper, enabling a plurality of axial mounting orientations between said firearm coupling device and the muzzle accessory.

9. The system of claim 8, wherein the muzzle accessory is a silencer booster piston.

10. A firearm coupling device comprising:

a body extending between a threaded barrel end receiving feature and a sealing alignment taper;

an outer surface of the body having a plurality of successively alternating lug clearance recesses and threaded lugs, wherein each said clearance recess and each said threaded lug, respectively, has a corresponding radial length, and wherein each said threaded lug is radially isolated by adjacent ones of the clearance recesses;

each said lug having a plurality of threads axially spaced apart by a pitch, each said thread defining a helix angle about the outer surface, wherein the helix angle is inconsistent with said pitch, wherein each said thread has a patterned geometry, the patterned geometry comprising:

a radial start point about a center of the body, each said start point relative to an axial position corresponding with a position of an associated lug clearance about said center of the body; and a through bore circumscribed by the body, whereby the patterned geometry enables fitment to a mating device geometry in a plurality of axial orientations.

* * * * *